United States Patent [19]

Araki

[11] Patent Number: 4,493,570

[45] Date of Patent: Jan. 15, 1985

[54] CONTROL SYSTEM FOR IMPACT PRINTER

[75] Inventor: Shigeyuki Araki, Komae, Japan

[73] Assignee: Ricoh Company, Ltd., Tokyo, Japan

[21] Appl. No.: 432,622

[22] Filed: Oct. 4, 1982

[30] Foreign Application Priority Data

Oct. 14, 1981 [JP] Japan ..... 56-162802
Nov. 2, 1981 [JP] Japan ..... 56-174476

[51] Int. Cl.[3] ..... B41J 1/30

[52] U.S. Cl. ..... 400/144.2; 400/51; 400/52; 400/279; 400/322

[58] Field of Search ..... 400/50–52, 400/144.2, 279, 322

[56] References Cited

U.S. PATENT DOCUMENTS 4,030,591 6/1977 Martin et al. ..... 400/51
4,189,246 2/1980 Kane et al. ..... 400/51 X
4,232,975 11/1980 Kane ..... 400/322 X

OTHER PUBLICATIONS

*IBM Tech. Disc. Bulletin,* by J. H. Meier et al., vol. 19, No. 1, Jun. 1976, pp. 115–117.
*IBM Tech. Disc. Bulletin,* by W. K. Bakezak et al., vol. 21, No. 12, May 1979, pp. 4759–4760.

*Primary Examiner*—Paul T. Sewell
*Attorney, Agent, or Firm*—David G. Alexander

[57] ABSTRACT

In an impact printing apparatus including a carriage which carries a rotary type element, the length of time required for a motor drive system for the carriage stop hunting and stabilize at a desired printing position depends on variables including the distance the carriage was moved, character pitch and the like. The apparatus senses these variables and delays hammering of the type element for printing for a length of time calculated to reduce the displacement of the carriage from the desired printing position caused by hunting to an acceptable value while maximizing the effective printing speed.

11 Claims, 16 Drawing Figures

200
50
MAIN CONTROL
60
SPS
202
SPE
208
52
204
54
CARRIAGE FEEDER
TYPE SELECTOR
SLD
SPC
210
206
214
212
SPA
70
SLA
216
68
66
64
62
224
222
220
218
4TH DELAY
3RD DELAY
84
2ND DELAY
1ST DELAY
88
Dt8
86
Dt6
Dt4
82
Dt2
232
230
228
226
90
234
92
HAMMER DRIVER
HME
80
236

CONTROL SYSTEM FOR IMPACT PRINTER

BACKGROUND OF THE INVENTION

The present invention relates to control systems for printers which may be used with computers, word processors and the like and, more particularly, to a control system for a high speed printer of the type in which a carriage carrying a type wheel with type members, type selection mechanism and/or hammering mechanism is moved predetermined distances to successively print out data on a sheet.

Generally, in a high speed impact printer, a type selection mechanism selects desired one of characters, symbols and other types carried on a type wheel. The selected type is pressed against a sheet through an inked ribbon or the like by a hammering mechanism. A carriage having the type wheel, type selection mechanism and/or hammering mechanism mounted thereon is moved a given distance to reproduce data on the sheet. A problem has existed in this type of printer due to hunting which results from the movement of the carriage or "movable printing member" as sometimes called hereinafter. After the carriage has shifted a given distance such as a distance corresponding to one character, it undergoes hunting and oscillates to opposite sides of a predetermined stop position. If the hammering mechanism is driven to reproduce data before the oscillation settles, the actual position on a sheet on which a type impinges becomes dislocated relative to a specified proper position. This results in irregular distribution of spacings along a train of characters on the sheet.

The same problem has also arisen when the type selector mechanism and type wheel on the carriage are to be driven individually to select one type out of various types carried on the type wheel.

A known expedient for overcoming such a problem consists in controlling the printer such that upon the lapse of a predetermined delay time after the movable printing member has completed a shift, the next motion, which is a type selecting motion, printing motion or spacing motion (sometimes termed generally as "printing operation" hereinafter), is initiated.

However, the time period necessary for the movable printing member to regain stability after a shift is not always constant. When the distance the printing member travelled at a time is relatively large as in the case of a tabulated movement, the printing member oscillates so greatly that a substantial time period is consumed before the vibration settles to stabilize the printing member. Even if the amount of a shift of the printing member is very small, oscillation still occurs due to a delay in response at a start of the shift because the velocity of the printing member sharply varies from acceleration to deceleration. This oscillation does not settle soon and, again, a substantial period of time is required before the printing member restores stability.

While such a situation may be coped with by lengthening the delay time after a shift of the printing member, a longer delay time results in a slower printing rate of the printer and, accordingly, a slower data processing rate of the whole system.

Where the delay time after a shift of such a movable printing member is fixed, another problem arises that the alignment of reproduced characters becomes poor. Generally, the amount of a shift of the movable printing member in printing operation depends on the size of characters to be printed out, i.e. the size of types used.

Thus, the fixed delay time may be optimum for one size of types but not for another size of types, significantly degrading the alignment of characters reproduced by the latter size of types.

SUMMARY OF THE INVENTION

A printer control system embodying the present invention controls a printing motion on the condition that a delay time expires after a shift motion of a movable printing member. The system comprises means for determining a variable condition of a movable printing member and means for setting a delay time in response to the variable condition of the movable printing member.

In accordance with the present invention, in a printer, a control system sets a delay time after a shift motion of a movable printing member and at the instant a printing motion is to occur. A variable condition of the movable printing member is determined and a delay time is selected in conformity to the variable shift condition. Because a sufficient delay time is set to meet any specific situation, a minimum of irregularity occurs in the spacings of characters printed out on a sheet.

It is therefore an object of the present invention to provide a printer control system which substantially eliminates the problem attributable to hunting of the movable printing member without lowering the printing rate.

It is another object of the present invention to provide a printer control system which causes the printing member to stop exactly at a predetermined position even after an uninterrupted or continuous movement.

It is another object of the present invention to provide a printer control system which substantially frees printed characters from irregular intercharacter spacings without reducing the printing rate.

It is another object of the present invention to provide a printer control system which sets up desired alignment among reproduced characters despite a change in the amount of a shift of the printing member.

It is another object of the present invention to provide a generally improved printer control system.

Other objects, together with the foregoing, are attained in the embodiments described in the following description and illustrated in the accompanying drawings.

DESCRIPTION OF THE PREFERRED EMBODIMENTS

While the impact printer control system of the present invention is susceptible of numerous physical embodiments, depending upon the environment and requirements of use, substantial numbers of the herein shown and described embodiments have been made, tested and used, and all have performed in an eminently satisfactory manner.

Figure 1:
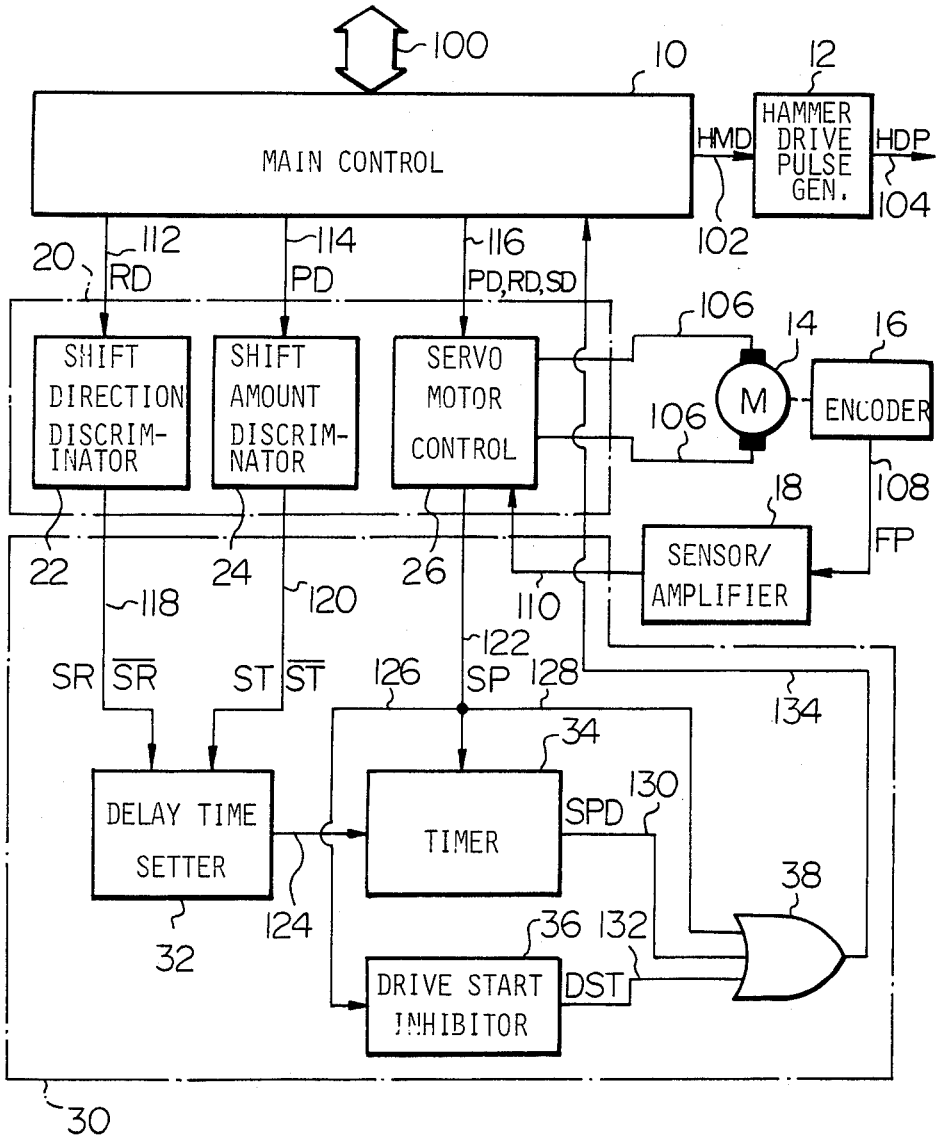
FIG. 1 is a block diagram of a printer control system embodying the present invention.

Referring to FIG. 1 of the drawing, a printer control system of the present invention includes a main control circuit 10 which is connected with a computer or like external system by a bus 100. Data required for printing operation is transferred from the computer to the main control circuit 10.

A hammer drive pulse generator 12 is connected to the main control circuit 10 by a line 102 in order to generate pulses for driving a hammer mounted on a carriage, which is the movable printing member though not shown in the drawing. Output pulses of the hammer drive pulse generator 12 are fed to the outside by a line 104. A servo motor control circuit 26 connects to the main control circuit 10 through a line 116 and also to a servo motor 14 through a line 106. The servo motor 14 serves to index the carriage over a required distance. An encoder 16 is associated with the servo motor 14 to determine a position of the carriage. The main control circuit 10 supplies the servo motor control circuit 26 with step number data PD indicating a distance or amount the carriage moved in terms of a number of rotation steps of the servo motor 14, shift direction data RD indicating a direction of a movement of the carriage, and a shift motion start signal SD indicating a start of a movement of the carriage.

The encoder 16 connects through a line 108 to a sensor/amplifier circuit 18 so as to supply it with feedback pulses FP, which represent positions of the carriage. The sensor/amplifier circuit 18 produces amplified versions of the input feedback pulses FP. The sensor/amplifier circuit 18 connects through a line 110 to the servo motor control circuit 26, feeding the amplified feedback pulses FP thereto. A timer circuit 34 is connected with the servo motor control 26 by a line 122. The servo motor control 26 drives the servo motor 14 and, accordingly, the carriage by processing the step number data PD, shift direction data RD, motion start signal SD and feedback pulses FP. The servo motor control 26 supplies the timer 34 as well as others, which will be described, with a shift motion signal SP which becomes "H" level in response to a drive of the servo motor 14.

Also connected with the main control 10 is a shift amount discrimination circuit 24, the connection employing a line 114. The shift amount discrimination circuit 24 determines an amount of displacement of the carriage in response to step number data PD fed thereto from the main control 10. In this embodiment, the shift amount discriminator 24 is constructed to determine whether the number of steps is 16 or larger, indicating a relatively large intercharacter spacing, or 15 or smaller, indicating a relatively small intercharacter spacing. The discriminator 24 connects through a line 120 to a delay time setting circuit 32 to supply it with a discrimination output ST in response to 15 or less steps and a discrimination output $\overline{ST}$ in response to 16 or more steps.

Further connected with the main control 10 through a line 112 is a shift direction discrimination circuit 22. The main control 10 couples shift direction data RD to the shift direction discrimination circuit 22 which then determines a direction of movement of the carriage. The discriminator 22, in the illustrated embodiment, is designed to determine whether the shift direction of the carriage is the same as or different from the immediately preceding shift. The shift direction discriminator 22 connects through a line 118 to the delay time setting circuit 32 and supplies it with a discrimination output SR when the carriage shift direction is the same, but a discrimination output $\overline{SR}$ when the carriage shift direction is different. The main control 10 discriminates whether or not a printing operation for spacing continues; feeding the shift direction data RD to the shift direction discriminator 22 if it continues but the step number data PD to the shift amount discriminator 24 if not.

The delay time setting circuit 32 connects through a line 124 to the timer 34. The circuit 32 is adapted to set a delay time in accordance with a variable condition of the carriage, i.e. amount or direction of a shift of the carriage. The timer 34, therefore, sets a delay time therein which conforms to the signal ST, $\overline{ST}$ from the shift amount discriminator 24 or the signal SR, $\overline{SR}$ from the shift direction discriminator 22. In this embodiment, the delay time setting circuit 32 loads the timer 34 with a delay time of 1 msec in response to the signal ST, a delay time of 4 msec in response to the signal $\overline{ST}$, a delay time of 0 msec in response to the signal SR, and a delay time of 1 msec in response to the signal $\overline{SR}$.

The timer 34 connects to a 3-input OR gate 38 through a line 130. The timer 34 counts time until the delay time set by the delay time setter 32 expires, starting from the instant the shift motion signal SP from the servo motor control 26 lowers to "L" level, that is, the end of a shift of the carriage. The timer 34 feeds to the OR gate 38 a delay signal SPD which remains "H" level while the timer 34 so counts time.

The servo motor control 26 connects to a drive start inhibition circuit 36 through a line 126. The drive start inhibition circuit 36 produces a drive start inhibit signal DST which is kept "H" level until there expires a predetermined minimum period of time necessary from the instant the shift motion signal SP supplied from the servo motor control 26 rises to "H" level, meaning a start of a motion of the carriage, to the instant a hammer drive is started. The minimum period of time mentioned will be called the "minimum time" hereinafter. The minimum time implies a minimum time period required to reduce the influence of hunting involved in the movement of the carriage, 15 msec in this embodiment. The drive start inhibit signal DST is coupled to the OR gate 38 by a line 132. Though not shown in the drawing, an arrangement is made such that the supply of the signal DST to the OR gate 38 is interrupted while the carriage moves uninterruptedly or continuously.

The shift motion signal SP from the servo motor control 26 is also coupled to the OR gate 38 by a line 128. Connected to the main control 10 by a line 134, the OR gate 38 delivers to the main control 10 AND of the shift motion signal SP, delay signal SPD and drive start inhibit signal DST. When the output of the OR gate 38 rises to "L" level, the main control 10 produces a signal for the next action. If the signal specifies a printing motion, a hammer drive start signal HMD is supplied to the drive pulse generator 12 but, if it designates a spacing motion, a shift start signal SD is supplied to the servo motor control 26. In response to the signal HMD, the hammer drive pulse generator 12 delivers a hammer drive pulse HDP.

Thus, the shift direction discriminator 22, shift amount discriminator 24 and servo motor control 26 constitute in combination means for determining variable conditions of the carriage as generally designated by the reference numeral 20. Meanwhile, the delay time setter 32, timer 34, drive start inhibitor 36 and OR gate 38 constitute means for setting a delay time in response to the variable conditions of the carriage as generally designated by the reference numeral 30.

Operation of the printer control system will be described with reference to the timing charts shown in FIGS. 2–8 and the flowchart shown in FIG. 9.

Figure 2:
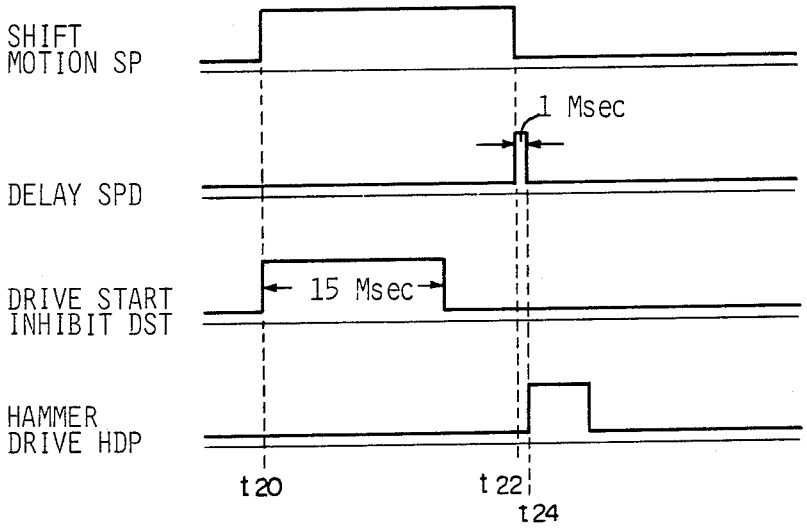
FIGS. 2 and 3 are timing charts indicating a case in which a character is to be printed out after a shift of a carriage and, particularly, a case in which the amount of a shift is different.
Figure 3:
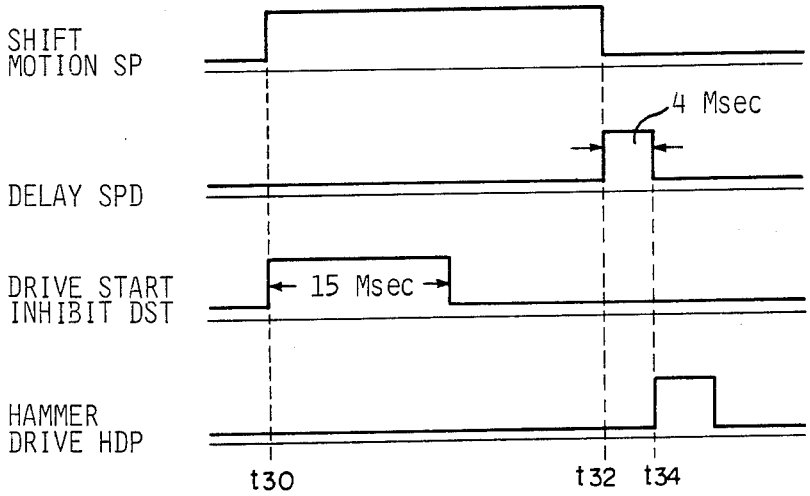
Figure 4:
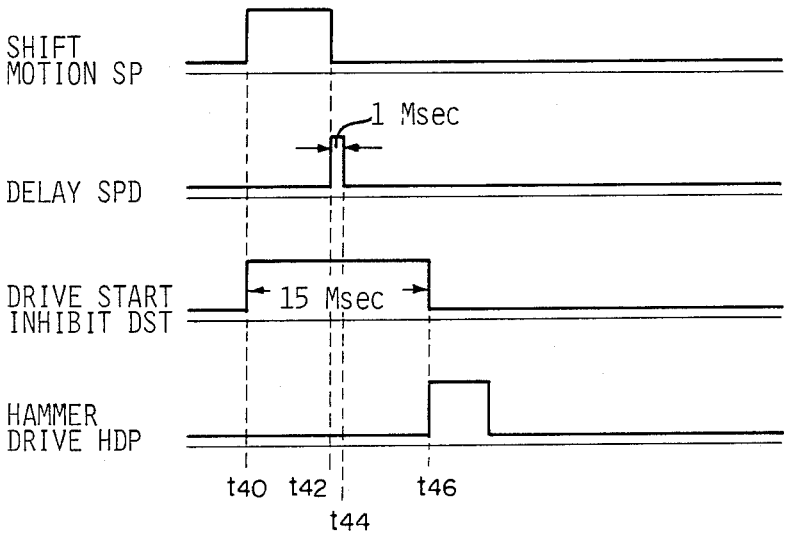
FIG. 4 is a timing chart indicating a case in which the carriage moves a relatively short period of time.

FIGS. 2–4 represent a case wherein a printing motion, as distinguished from a spacing motion, follows a shift of the carriage. In FIG. 2, the number of steps is 10 indicating a relatively narrow intercharacter spacing. In FIG. 3, the number of steps is 20 indicating a relatively wide intercharacter spacing. In FIG. 4, the number of steps is 5 indicating an intercharacter spacing which is narrower than in FIG. 2.

First, the main control 10 supplies the servo motor control 26 with a motion start signal SD, step number data PD and shift direction data RD, while supplying the shift amount discriminator 24 with step number data PD. Then, as indicated by step 200 in FIG. 9, the servo motor control 26 drives the servo motor 14 in a given direction so that the carriage is shifted a predetermined amount in a direction indicated by the data RD. The shift motion signal SP and drive start inhibit signal DST both rise to "H" level at time $T_{20}$ in FIG. 2, time $T_{30}$ in FIG. 3 and $T_{40}$ in FIG. 4.

Figure 9:
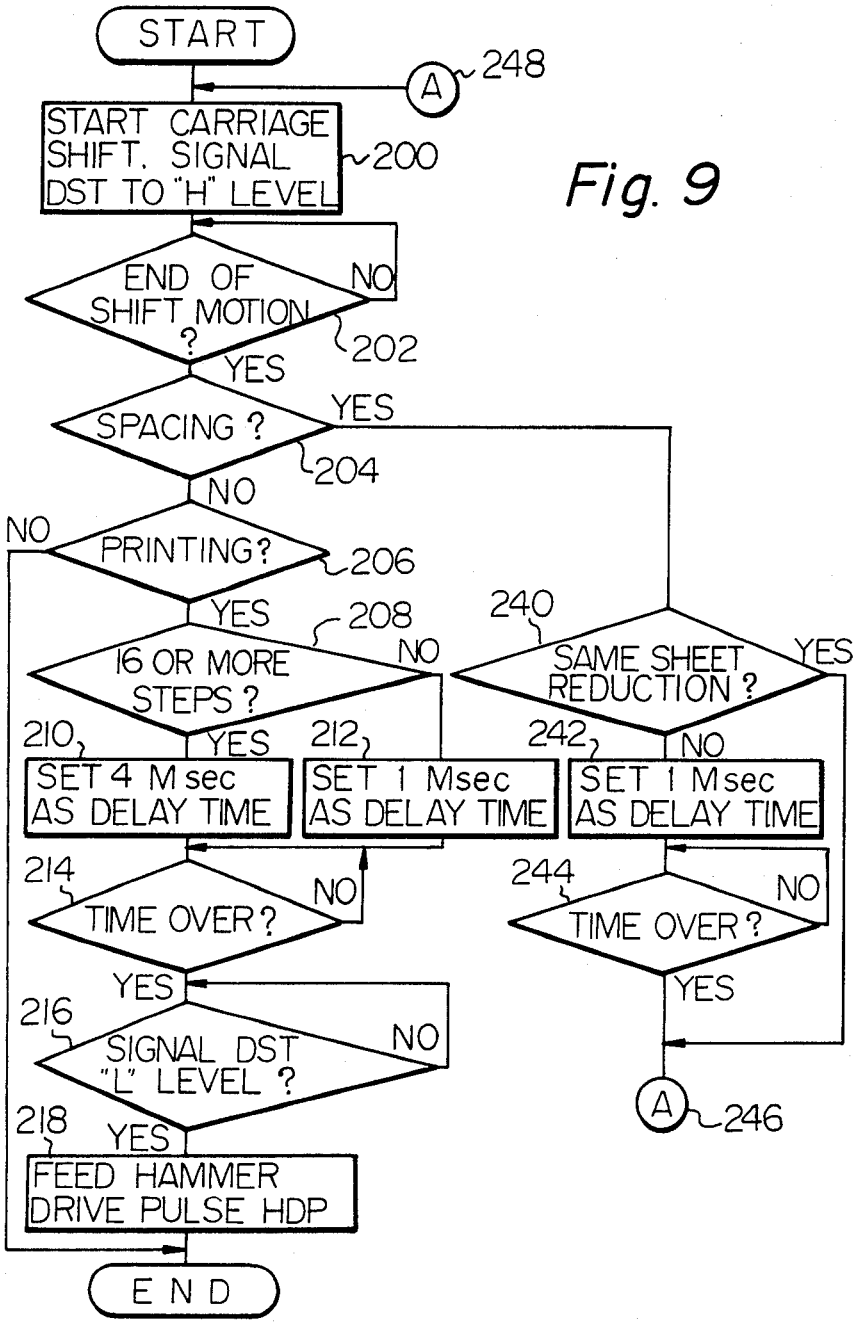
FIG. 9 is a flowchart demonstrating an outline of operation of the system shown in FIG. 1.

When the shift of the carriage is terminated as determined at step 202 in FIG. 9, whether or not the action to occur then is a spacing motion is determined at step 204. Then, at step 206, whether the expected motion is a printing motion is decided. These are all performed by the main control 10. At step 208, the shift amount discriminator 24 discriminates a shift amount. In the examples shown in FIGS. 2 and 4, the number of steps is 15 or less so that the discrimination output ST is coupled to the delay time setter 32 and, accordingly, 1 msec is loaded in the timer 34 as a delay time as shown in step 212 in FIG. 9. In the example of FIG. 3, the number of steps is 16 or more and the discrimination output $\overline{ST}$ is coupled to the delay time setter 32, whereby the timer 34 is loaded with 4 msec as a delay time as shown in step 210 in FIG. 9. The timer 34 starts counting the loaded delay time at step 214 in FIG. 9, at the instant the shift motion signal SP rises to "L" level, i.e. time $T_{22}$, $T_{32}$ or $T_{42}$ in FIGS. 2, 3 or 4. The delay time expires at time $T_{24}$, $T_{34}$ or $T_{44}$ in FIGS. 2, 3 or 4 so that the delay signal SPD lowers to "L" level.

Concerning the case shown in FIG. 2, because the time period necessary for the 10-step movement of the carriage is longer than the minimum time (15 msec), the drive start inhibit signal DST has already gained "L" level at time $T_{24}$ in FIG. 2, as indicated by step 216 in FIG. 9. At time $T_{24}$, therefore, the output of the OR gate 38 turns from "H" level to "L" level to cause the main control 10 to produce a hammer drive start signal HMD. As a result, the hammer drive pulse generator 12 delivers a hammer drive pulse HDP as indicated by step 218 in FIG. 9.

Likewise, in the case of FIG. 3, the hammer drive pulse generator 12 produces a hammer drive pulse HDP at time $T_{34}$.

In the case shown in FIG. 4, the time period required for the 5-step carriage movement is shorter than the minimum time (15 msec). It follows that the drive start inhibit signal DST has not become "L" level at time $T_{44}$. Accordingly, at time $T_{46}$ when the drive start inhibit signal DST becomes "L" level as at step 216 in FIG. 9, the hammer drive pulse generator 12 generates a hammer drive pulse HDP as indicated in step 218. In this way, the delay time is substantially lengthened by the fragment of time between times $T_{44}$ and $T_{46}$.

Thus, in this embodiment, a 4 msec of delay time is employed when the shift amount of the carriage is 16 steps or more. Hence, even during printing operation in tabulation mode, the intercharacter spacing can be accurately regularized because, whenever the hammer starts to be driven, the oscillation of the carriage and type element carried thereon has settled and a type member has been accurately positioned. This advantage is attainable without lowering the printing rate in view of the fact that the delay time is made 1 msec when the amount of a shift is 15 steps or less. Meanwhile, when the amount of a shift is small, the rough two-stage correspondence between the carriage shift amount and the delay time may allow the carriage to still oscillate even after the lapse of the delay time. Nevertheless, regular intercharacter spacing is insured because a hammer drive is inhibited until 15 msec expires after the start of a shift motion, that is, it is only after such oscillation settles that the hammer starts to be driven.

In the procedure shown in FIGS. 2–4, the main control 10 does not supply the shift direction data RD to the shift direction discriminator 22 which, therefore, does not supply the discrimination output SR or $\overline{SR}$.

Figure 5:
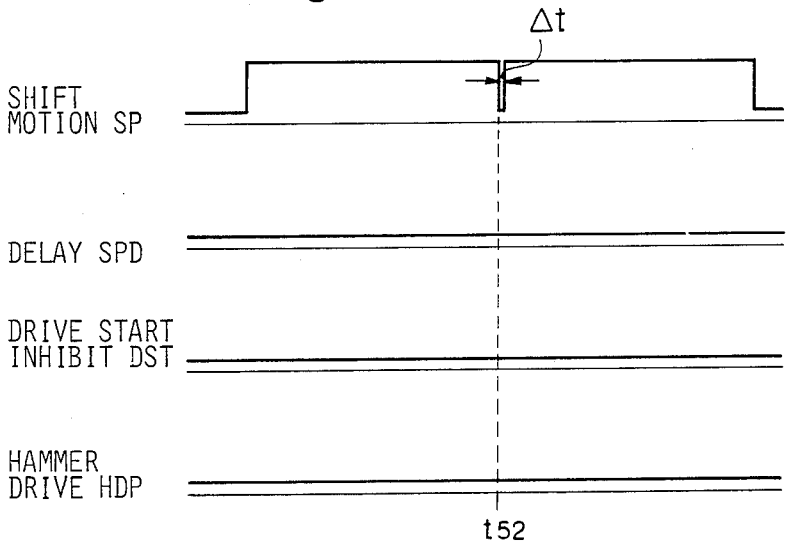
FIGS. 5 and 6 are timing charts representing a case in which a space is to be inserted after a shift of the carriage; and, particularly, a case in which the direction of a shift is different.
Figure 6:
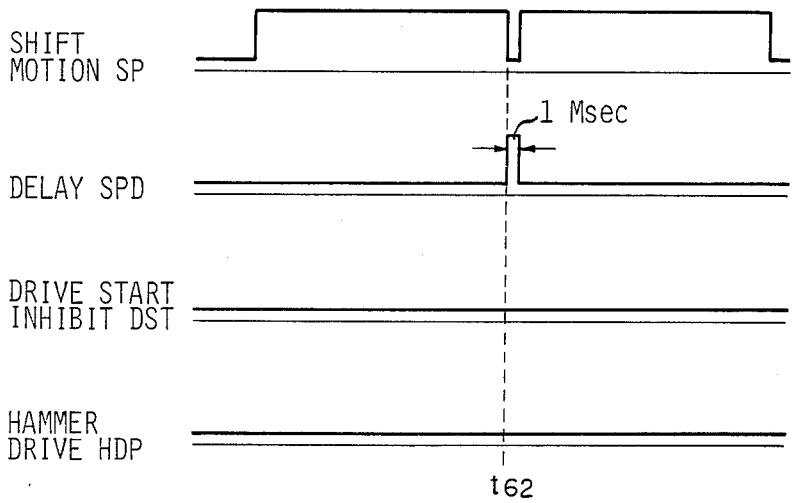

FIGS. 5 and 6 show an exemplary case in which a shift of the carriage, a spacing motion and another shift of the carriage occur in sequence.

In FIG. 5, such shifts of the carriage proceed in the same direction. Then, the main control 10 supplies the servo motor control 14 with a shift motion start signal SD, step number data PD and shift direction data RD, while supplying the shift direction discriminator 22 with shift direction data RD. In response to these signals, the servo motor control 14 moves the carriage a desired distance as at step 200 in FIG. 9. In this situation, the drive start inhibit signal DST is held at "L" level. When the shift of the carriage is terminated as at time $T_{52}$ shown in FIG. 5, the shift motion signal SP becomes "L" level. At step 204 in FIG. 9, whether or not the specified motion is a spacing motion is determined and, at step 240, a direction of the carriage shift is determined. In FIG. 5, because the shifting direction of the carriage remains the same, the delay time is 0 msec so that the carriage immediately starts another shift with no hammer drive pulse HDP generated, as indicated by steps 246 and 248 in FIG. 9. The timing chart of FIG. 5 involves a time period $\Delta T$ which is consumed for signal processing and lies within the range of 0.1–0.3 msec when a microcomputer is used. FIG. 6 indicates a case in which the direction of carriage movement is switched from one to the other. The procedure which occurs this time is substantially similar to that discussed in conjunction with FIG. 5. However, as at steps 240 and 242 in FIG. 9, the delay time setter 32 loads the timer 34 with a delay time of 1 msec. The timer 34, therefore, starts counting the 1 msec delay time at time $T_{62}$ in FIG. 6 at which the shift motion signal SP becomes "L" level. As the delay time expires, the next shift motion of the carriage is started as at continuous steps 246 and 248.

Thus, during continuous shift motions, the delay time is made zero if the shift direction is the same and is made 1 msec when the shift direction is reversed. Consequently, continuous shifts of the carriage can be sped up. Moreover, the carriage can be accurately stopped at a predetermined position due to the absence of misstepping which might result from hunting upon reversion of the shift direction.

Now, in a printer using a type element in the form of a rotatable wheel, the type wheel is rotated until a desired type member is brought to a predetermined position where it can be hit by a hammer. After this type selection, the hammer is driven to impinge on the selected type member upon the lapse of a predetermined selection delay time. The embodiment described with reference to FIGS. 1–9 is applicable to such a printer. If the selection delay time is determined in accordance with an angular movement of the type wheel, the intercharacter spacing can be regularized without lowering the printing rate. Further, if a hammer drive is inhibited until a given period of time (corresponding to the previously mentioned "minimum time") expires after the start of a type selection, regular intercharacter spacing can be ensured without slowing down the printing operation because, whenever a printing action starts, the oscillation of the type wheel due to a delay in response at a start of type selection has settled.

Figure 7:
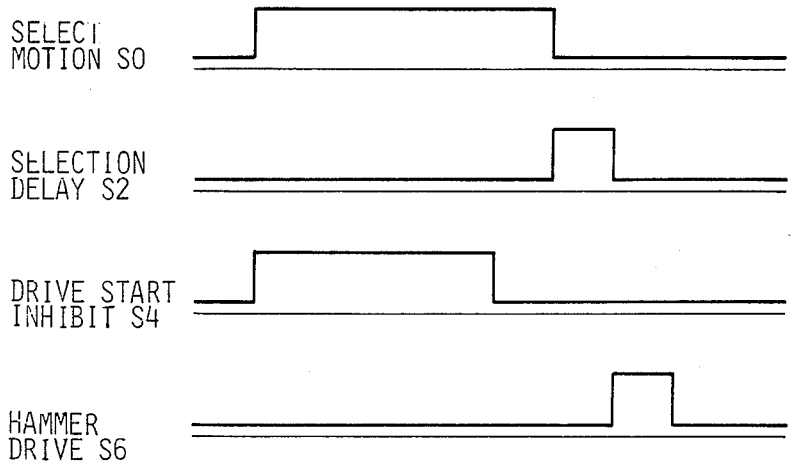
FIGS. 7 and 8 are timing charts representing an exemplary printer operation in which a hammer is driven upon the lapse of a given delay time after a type wheel has been rotated to locate a desired type in a position which the hammer is to impact.

Referring to FIG. 7, there are shown various signals which will appear during type selection in a printer of the kind described above. The procedure shown in FIG. 7 corresponds to the procedure indicated in FIG. 2 or 3. A select motion signal S0 corresponds to the shift motion signal SP, a selection delay signal S2 to the delay signal SPD, a drive start inhibit signal S4 to the signal DST, and a hammer drive pulse S6 to the pulse HDP. In short, the timed operation shown in FIG. 7 is common to that of FIG. 2 or 3 if the angular movement of the type wheel is matched with the linear movement of the carriage.

Figure 8:
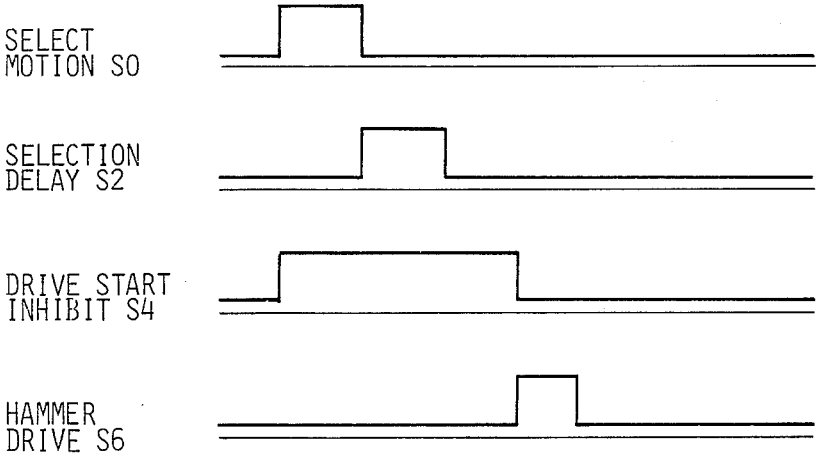

The signals S0, S2, S4 and S6 will vary as indicated in FIG. 8 when the type selection is performed in the manner described in conjunction with FIG. 4.

Referring to FIGS. 10-16, another embodiment of the printer control system of the present invention will be described.

Figure 10:
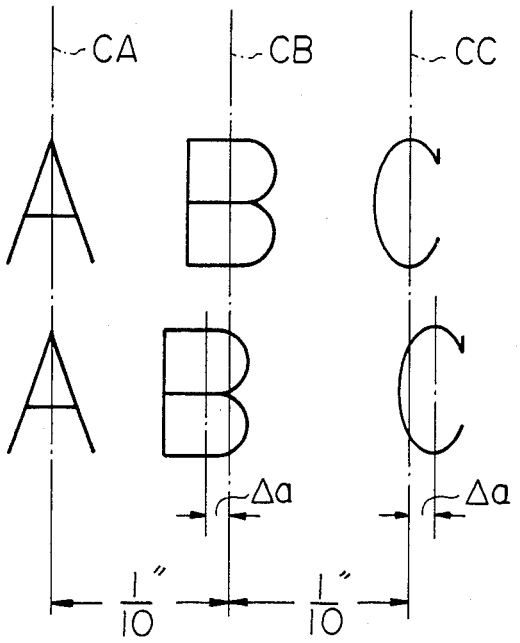
FIGS. 10 and 11 are views explanatory of character alignment with respect to different character pitches.
Figure 11:
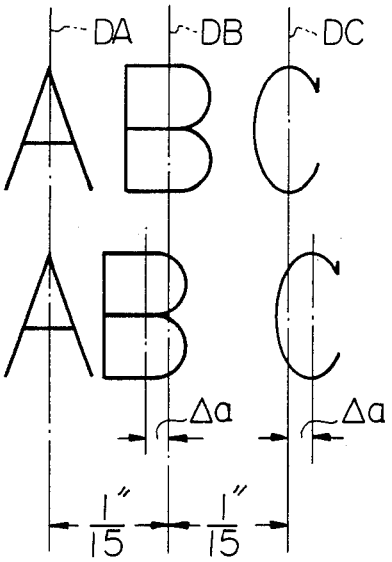

FIGS. 10 and 11 indicate exemplary characters for explaining character alignment. The character trains shown in FIG. 10 correspond to a printing pitch of 1/10 inch, and those shown in FIG. 11 correspond to a printing pitch of 1/15 inch. In each of FIGS. 10 and 11, the upper train of characters are in proper positions and the lower train of characters are in positions each being dislocated within an allowable range. Character "A" in the lower train of FIG. 10 has a center aligned with the center CA of character "A" in the upper train; character "B" in the lower train has a center dislocated an amount Δa to the left relative to the center CB of character "B" in the upper train; and character "C" in the lower train has a center dislocated an amount Δa to the right relative to the center CC of character "C" in the upper train. The deviation Δa results from hunting which occurs during movement of a carraige or that of a type wheel and its magnitude depends on the delay time described in the embodiment. Should the delay time be short, the deviation Δa would increase because a printing motion would occur while the vibration of the carriage or type wheel is relatively large. Should the delay time be long, the deviation Δa would increase because a printing motion would occur while the vibration of the carriage or type wheel is relatively small.

Supposing that the deviation Δa shown in FIG. 10 is optimum, changing the printing pitch to 1/15 without any modification to the delay time corresponding to the deviation Δa gives the character arrangement shown in FIG. 11. Again, the center of character "A" in the lower train is aligned with the center DA of character "A" in the upper train; the center of character "B" in the lower train is offset an amount Δa to the left relative to the center DB of character "B" in the upper train; the center of character "C" in the lower train is offset the amount Δa to the right relative to the center DC of character "C" in the upper train. Despite that the intercharacter spacing is smaller than in FIG. 10 due to the change of printing pitch from 1/10 to 1/15, the deviation remains the same because the delay time is the same. The result is a significant deterioration to the lateral alignment of characters, compared to the case with 1/10 inch printing pitch. The alignment PA(1/10) for the 1/10 inch printing pitch may be expressed as $$PA(1/10) = \frac{a}{1/10}$$

and the alignment PA(1/15) for the 1/15 printing pitch may be expressed as $$PA(1/15) = \frac{a}{1/15}$$

Thus, the ratio of the alignment of PA(1/15) to the alignment PA(1/10) is given by $$\frac{PA(1/15)}{PA(1/10)} = \frac{a}{1/15} \quad \frac{a}{1/10} = 1.5$$

It will be seen that the change in printing pitch from 1/10 inch to 1/15 inch makes the alignment with the latter pitch 1.5 times as poor as the alignment with the former pitch.

This problem may be solved by predetermining a delay time optimum for the printing operation with the 1/15 inch pitch, so that the delay time can be lengthened to diminish the deviation Δa. Such an expedient, however, disadvantageously slows down the printing operation due to the longer delay time.

The embodiment which will be described with reference to FIGS. 12–16 contemplates to overcome the conflict mentioned above.

Figure 12:
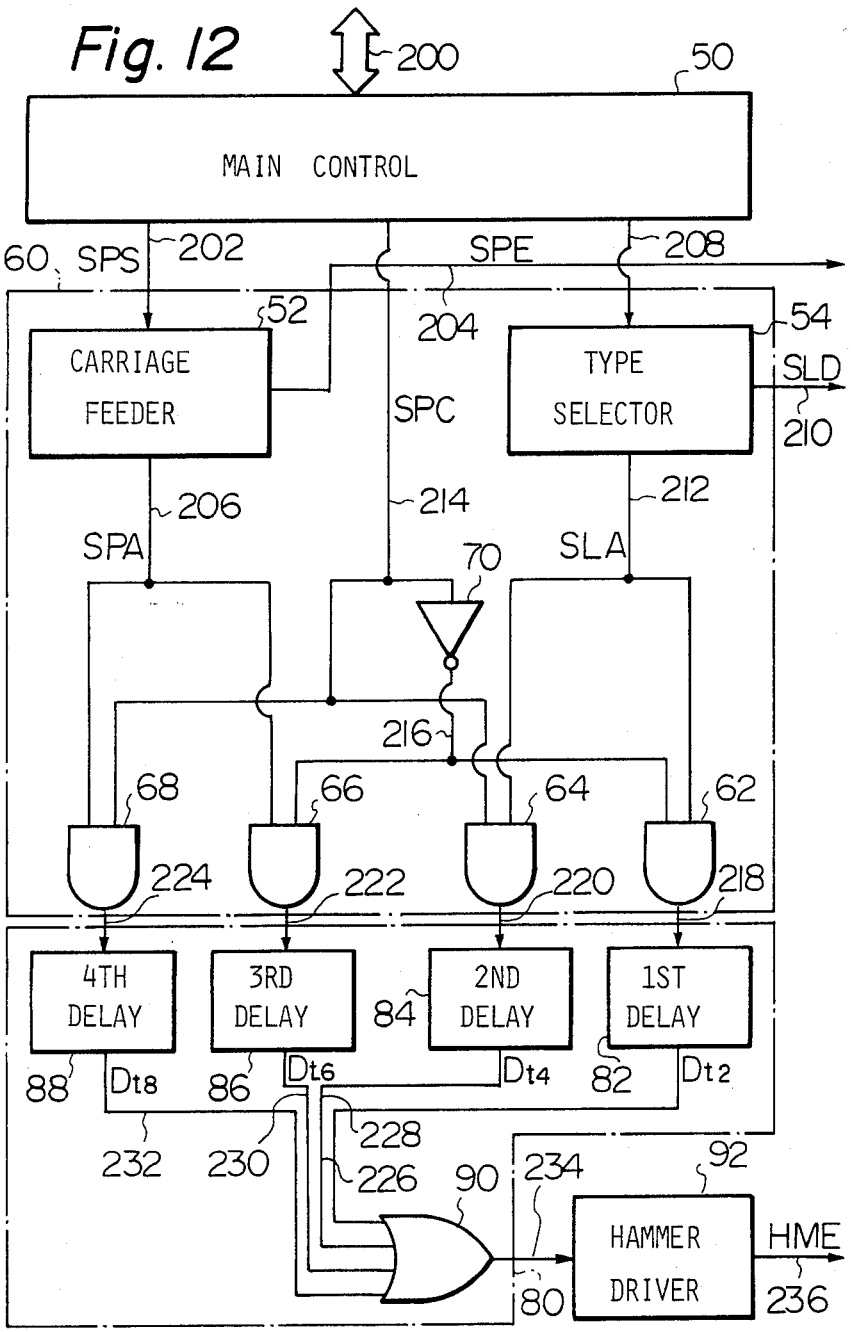
FIG. 12 is a block diagram of another embodiment of the present invention.

Referring to FIG. 12, the printer control system includes a main control circuit 50 which is connected with an external system such as a computer (not shown) by a bus 200. As in the first embodiment, data required for printing operation is fed from the computer to the main control circuit 50. Connected with the main control 50 through a line 202 is a carriage feed circuit 52. A shift amount signal SPS indicating an amount of a carriage shift is supplied from the main control 50 to the carriage feed circuit 52. In response to the signal SPS, the carriage feed circuit 52 feeds a shift drive signal SPE to a drive motor (not shown) via a line 204. The shift drive signal SPE operates the drive motor to feed the carriage through a distance of 1/10 inch or 1/15 inch.

The carriage feed circuit 52 connects via a line 206 to 2-input AND gates 66 and 68 and supplies them with a shift motion signal SPA which becomes "H" level during a shift of the carriage and "L" level at the end of the shift. The shift motion signal SPA corresponds to the shift motion signal SP in the embodiment of FIG. 1 while the carriage feed circuit 52 corresponds to the servo motor control 26.

Also connected with the main control 50 via a line 208 is a type selection circuit 54. A select signal SLE is coupled from the main control 50 to the type selector 54 indicating a character to be printed out. The type selector 54 in response to the signal SLE supplies a type selecting motor (not shown) with a selection drive signal SLD via a line 210. The signal LSD drives the motor to rotate a type wheel (not shown) until a type member matching with the desired character becomes located in a printing position.

The type selector 54 connects to 2-input AND gates 62 and 64 via a line 212. Fed from the type selector 54 to these AND gates 62 and 64 is a type select motion signal SLA which becomes "H" level during type selection and turns to "L" level upon completion of the type selection.

AND gates 64 and 68 and a NOT circuit 70 are individually connected with the main control 50 by a line 214 to be supplied with a shift amount signal SPC which becomes "L" level for the printing pitch of 1/10 inch and turns to "H" level for the printing pitch of 1/15 inch.

The NOT circuit 70 connects to AND gates 62 and 66 via a line 216. The AND gates 62, 64, 66 and 68 connect to first to fourth delay circuits 82, 84, 86 and 88 via lines 218, 220, 222 and 224, respectively. The delay circuits 82, 84, 86 and 88 respectively produce predetermined delay signals $D_{t2}$, $D_{t4}$, $D_{t6}$ and $D_{t8}$ which remain "H" level until predetermined delay times $t_2$, $t_4$, $t_6$ and $t_8$ expire after the change of the corresponding AND gates 62, 64, 66 and 68 from "H" level to "L" level. The delay time $t_2$ is shorter than the delay time $t_4$ ($t_2<t_4$) while the delay time $t_6$ is shorter than the delay time $t_8$ ($t_6<t_8$)

All the delay circuits 82–88 connect to a 4-input OR gate 90 through lines 226, 228, 230 and 232, respectively, supplying it with the delay signals $D_{t2}$, $D_{t4}$, $D_{t6}$ and $D_{t8}$. The OR gate 90 connects to a hammer drive circuit 92 via a line 234. The hammer drive circuit 92 delivers a hammer drive signal HME to a hammer drive mechanism (not shown) via a line 236 when the output of the OR gate 90 turns to "L" level.

Again, the carriage feeder 52, type selector 54, NOT circuit 70 and AND gates 62–68 constitute means for determining shift conditions of the carriage and type wheel as generally denoted by the reference numeral 60. The delay circuits 82–88 and OR gate 90 constitute means for setting a delay time in accordance with the shift conditions of the movable printing member as generally denoted by the reference numeral 80.

The system shown in FIG. 12 is operated as will be described with reference to the timing charts of FIGS. 13–16.

Figure 13:
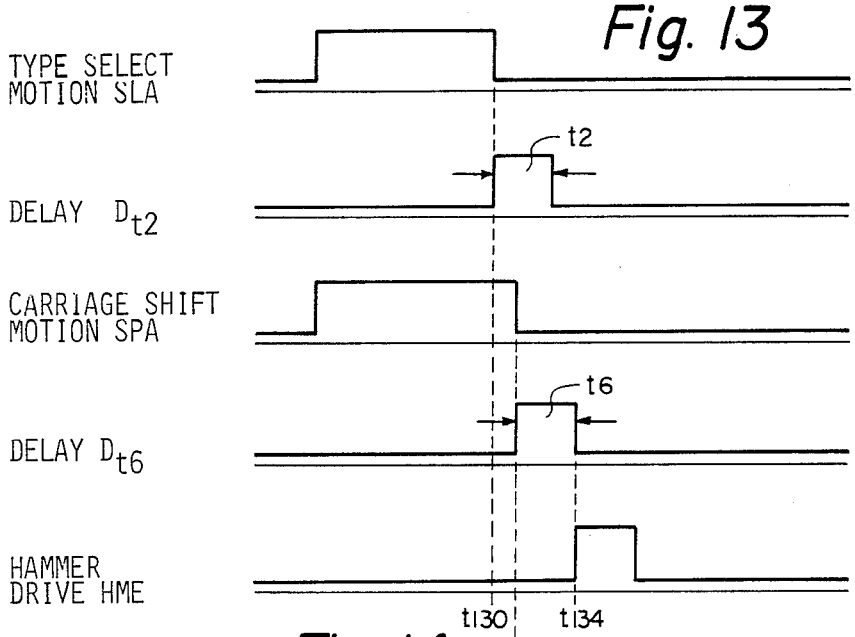
FIGS. 13–16 are timing charts indicating control actions of the system shown in FIG. 12.
Figure 14:
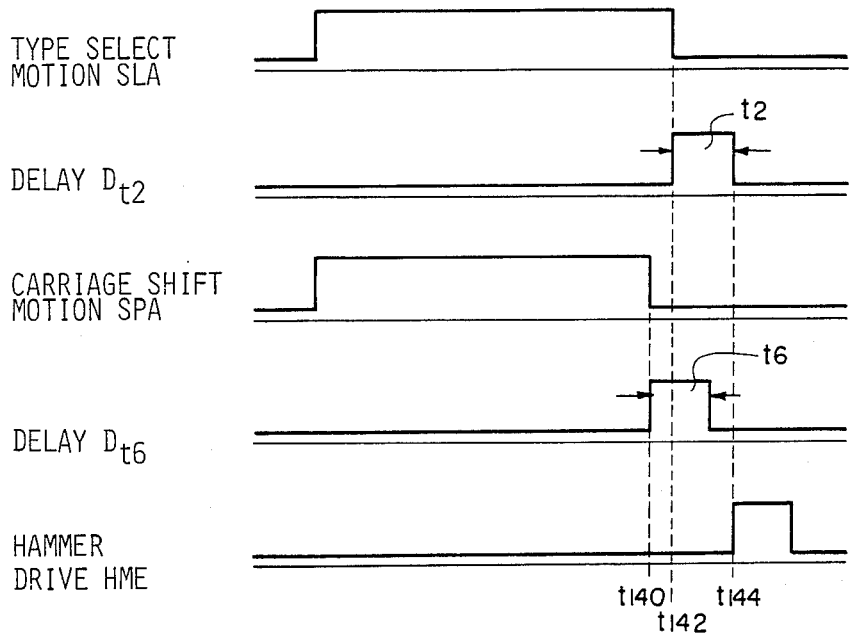

FIGS. 13 and 14 show a case in which the printing pitch is 1/10 inch. The shift amount signal SPC from the main control 50 is "L" level so that the AND gates 62 and 66 remain opened and the AND gates 64 and 68 remain closed. Under this condition, the type select motion signal SLA from the type selector 54 is coupled to the first delay circuit 82 and the carriage shift motion signal SPA from the carriage feeder 52 is coupled to the third delay circuit 86. The signals rise and lowers in the manner shown in FIG. 13 when the time period necessary for a shift motion of the carriage is longer than that required for a type select motion, and in the manner shown in FIG. 14 when the former is shorter than the latter.

In the situation indicated in FIGS. 13 and 14, the first delay circuit 62 delivers a delay signal $D_{t2}$ when a type selecting motion is completed, that is, at time $t_{130}$ or $t_{142}$ at which the type select motion signal SLA lowers to "L" level. The third delay circuit 66 delivers a delay signal $D_{t6}$ when a shift motion of the carriage is terminated, that is, at time $t_{132}$ or $t_{140}$ at which the shift motion signal SPA lowers to "L" level. The delay signals $D_{t2}$ and $D_{t6}$ are both coupled to the OR gate 90. Thus, the output of the OR gate 90 becomes "L" level at time $t_{134}$ or $t_{144}$ at which one of the delay signals $D_{t2}$ and $D_{t6}$ later than the other lowers. Then, the hammer drive 92 delivers a hammer drive signal HME.

In FIG. 13, the delay signal $D_{t6}$ lowers later than the delay signal $D_{t2}$, the hammer drive signal HME appearing at the trailing end $t_{134}$ of the delay signal $D_{t6}$.

In FIG. 14, on the other hand, the delay signal $D_{t2}$ lowers later than the delay signal $D_{t6}$ and, accordingly, the hammer drive signal HME appears at the trailing end $t_{144}$ of the delay signal $D_{t2}$.

Figure 15:
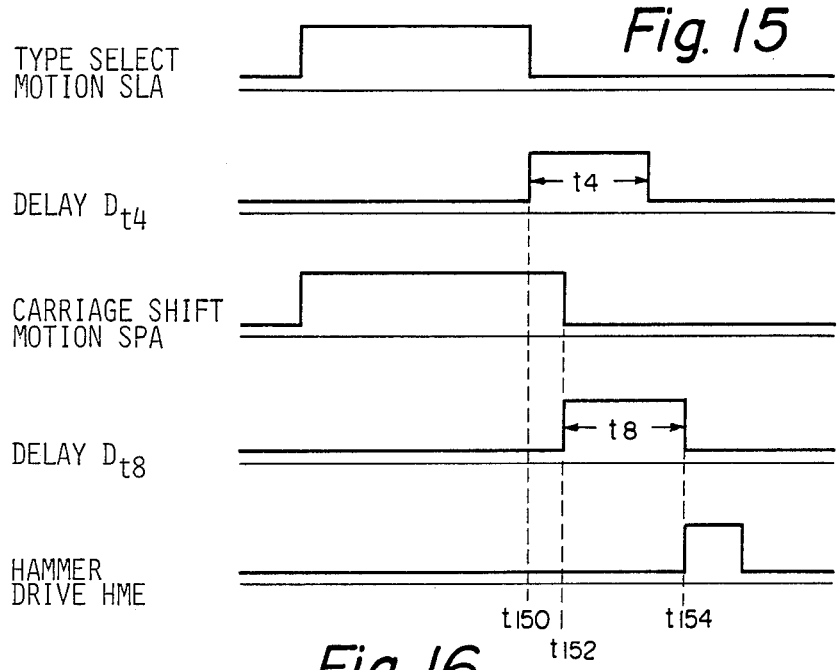
Figure 16:
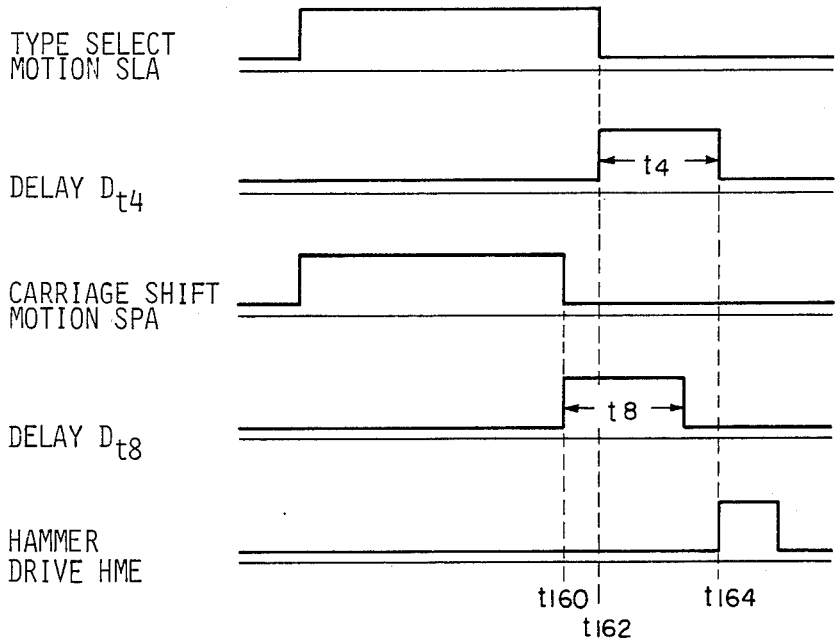

FIGS. 15 and 16 represent a case in which the printing pitch is 1/15 inch. The shift amount signal SPC from the main control 50 is "H" level this time. Under this condition, the AND gates 64 and 68 are opened and the AND gates 62 and 66 are closed. The type select motion signal SLA from the type selector 54 is coupled to the second delay circuit 84, while the shift motion signal SPA from the carriage feeder 52 is coupled to the fourth delay circuit 86. FIG. 15, like FIG. 13, indicates a case in which the time period required for a carriage shift motion is longer than that required for a type selecting motion. FIG. 16, like FIG. 14, indicates a case in which the time period necessary for a type selecting motion is longer than that necessary for a carriage shift motion.

In FIGS. 15 and 16, the second delay circuit 64 delivers a delay signal $D_{t4}$ when a type selecting motion is completed, that is, at time $t_{150}$ or $t_{162}$ at which the type select motion signal SLA lowers to "L" level. Meanwhile, the fourth delay circuit 68 delivers a delay signal $D_{t8}$ when a carriage shift motion is terminated, that is, at time $t_{152}$ or $t_{160}$ at which the carriage shift motion signal SPA lowers to "L" level. The delay signals $D_{t4}$ and $D_{t8}$ are both coupled to the OR gate 90. Thus, the output of the OR gate also lowers to "L" level when one of the delay signals $D_{t4}$ and $D_{t8}$ later than the other lowers, i.e. time $t_{154}$ or $t_{164}$. The hammer drive circuit 92 feeds a hammer drive signal HME in response to the "L" level output of the OR gate 90.

In FIG. 15, the delay signal $D_{t8}$ lowers later than the delay signal $D_{t4}$ so that the hammer drive signal HME appears at the trailing end $t_{154}$ of the delay signal $D_{t8}$.

In FIG. 16, the delay signal $D_{t4}$ lowers later than the delay signal $D_{t8}$ so that the hammer drive signal HME appears at the trailing end $t_{164}$ of the delay signal $D_{t4}$.

Because delay times $t_2$, $t_4$, $t_6$ and $t_8$ are open to choice and, moreover, they are selected in response to a change in character pitch, a change in pitch does not affect the alignment or slow down the printing cycles.

It should be remembered that the printing or character pitches of 1/10 and 1/15 inches employed for the embodiment are not restrictive but only illustrative.

In summary, it will be seen that the present invention desirably regulates intercharacter spacings to provide good alignment without lowering the printing rate and allows a movable printing member to move continuously at a high speed.

Various modifications will become possible for those skilled in the art after receiving the teachings of the present disclosure without departing from the scope thereof. For example, though the correspondence between the carriage shift amounts and the delay times has been considered with respect to two different stages (1–15 steps and 16 and larger steps), the steps may naturally be divided into three, four or more states. The gist is that the number of stages should only conform to required characteristics and functions of a printer. Also, the delay times are not limited to those described in conjunction with the embodiment but may be varied to optimumly meet specific characters and functions of a printer.

Instead of changing the delay time to match it with a particular shift amount of the carriage, it is permissible to merely inhibit a drive of the hammer for the previously mentioned minimum time. This also avoids an irregular intercharacter spacing when the carriage moves a small amount.

In an impact printer of the type which performs a spacing motion and a type selecting motion at the sametime, the control indicated in FIGS. 2-6 and the control indicated in FIGS. 7 and 8 may be employed in combination.

Apart from the carriage or the type wheel described, the movable printing member may take various other forms such as a type drum, type chain, type belt and type bar. In any case, delay times will be set and controlled in exactly the same way based on their variable conditions.

What is claimed is:

1. An impact printing apparatus including a movable carriage, a rotary type element mounted on the carriage, drive means for driving the carriage to and stopping the carriage at a desired printing position and hammer means for hammering the type element for printing at the desired printing position, characterized by comprising:

delay means for controlling the hammer means to hammer the type element at the expiration of a variable delay time which begins when the carriage has been driven to the desired printing position by the drive means; and control means responsive to a distance of movement of the carriage from a previous position to the desired printing position and setting the delay time of the delay means in accordance with a predetermined function thereof.

2. An impact printing apparatus as claimed in claim 1, in which the predetermined function is selected such that the delay time is longer for a large movement of the carriage than for a small movement of the carriage.

3. An impact printing apparatus as claimed in claim 1, in which the predetermined function is selected such that the delay time is longer for a tabulation movement of the carriage than for an intercharacter spacing movement of the carriage.

4. An impact printing apparatus as claimed in claim 1, in which the delay means comprises a variable timer, the control means being constructed to set the delay time into the timer.

5. An impact printing apparatus as claimed in claim 1, in which the control means is further constructed to compensate the delay time in a predetermined manner in accordance with whether or not a direction of movement of the carriage was reversed.

6. An impact printing apparatus as claimed in claim 1, in which the control means is further constructed to compensate the delay time in a predetermined manner in accordance with a size of a character to be printed.

7. An impact printing apparatus as claimed in claim 1, in which the control means is further constructed to compensate the delay time in accordance with a printing pitch of the printing apparatus.

8. An impact printing apparatus as claimed in claim 1, in which the control means is further constructed to compensate the delay time in accordance with a type selection time of the type element.

9. An impact printing apparatus as claimed in claim 1, in which the control means is further constructed to inhibit the hammer means from hammering the type element until a predetermined length of time has elapsed after a beginning of movement of the carriage.

10. An impact printing apparatus as claimed in claim 1, in which the drive means comprises a motor.

11. An impact printing apparatus as claimed in claim 10, in which the motor is a stepping motor.

* * * * *